US005324212A

United States Patent [19]

Fremgen et al.

[11] Patent Number: 5,324,212

[45] Date of Patent: Jun. 28, 1994

[54] DEVICE FOR DISCONNECTABLY CONNECTING CABLE WIRES

[75] Inventors: Dieter Fremgen, Wulfrath; Dieter Adamaszek, Kamen, both of Fed. Rep. of Germany; Jan Vansant, Korbeek; Filip Vandeputte, Linden, both of Belgium

[73] Assignee: Raychem Corporation, Menlo Park, Calif.

[21] Appl. No.: 937,901

[22] PCT Filed: Apr. 12, 1991

[86] PCT No.: PCT/GB91/00584

§ 371 Date: Oct. 14, 1992

§ 102(e) Date: Oct. 14, 1992

[87] PCT Pub. No.: WO91/16738

PCT Pub. Date: Oct. 31, 1991

[30] Foreign Application Priority Data

Apr. 14, 1990 [DE] Fed. Rep. of Germany ..... 4012225
Dec. 3, 1990 [GB] United Kingdom ..... 9026249

[51] Int. Cl.[5] ..... H01R 17/04

[52] U.S. Cl. ..... 439/412; 439/417; 439/402

[58] Field of Search ..... 439/395–407, 439/409, 410, 411, 417–419, 791, 792, 796, 797, 810–814, 789

[56] References Cited

U.S. PATENT DOCUMENTS

| | | | |
|---|---|---|---|
| 4,175,818 | 11/1979 | Kourimsky et al. | 439/395 |
| 4,541,679 | 9/1985 | Fiedler et al. | 439/395 |
| 4,793,822 | 12/1988 | Cozzens et al. | 439/397 |
| 4,793,824 | 12/1988 | Cozzens et al. | 439/417 |
| 5,006,077 | 4/1991 | Loose et al. | 439/395 |

FOREIGN PATENT DOCUMENTS

| | | | |
|---|---|---|---|
| 108518 | 5/1984 | European Pat. Off. . | |
| 315345 | 5/1989 | European Pat. Off. . | |
| 2451691 | 5/1975 | Fed. Rep. of Germany | 439/779 |
| 3216096 | 11/1983 | Fed. Rep. of Germany . | |
| 0419275 | 2/1967 | Switzerland | 439/811 |
| 494481 | 9/1990 | Switzerland . | |

*Primary Examiner*—David L. Pirlot
*Attorney, Agent, or Firm*—Herbert G. Burkard; William D. Zahrt, II; A. Stephen Zavell

[57] ABSTRACT

A device (1) is described for disconnectably connecting cable wires to a contact plate (2). The contact plate contains a through opening (9) and, in use, one of the cable wires to be contacted is urged into contact with the edges of that opening (9). The cable wire is moved by a thrust piece (3) which also contains a through opening (24) and which is moved relative to the through opening (9) in the contact plate by means of a screw element.

19 Claims, 10 Drawing Sheets

34
29
I
14'
30
14'
27'
33
I
32
36
37

28
14'
XI
XI
36
35

DEVICE FOR DISCONNECTABLY CONNECTING CABLE WIRES

BACKGROUND OF THE INVENTION

Field of the Invention

This invention relates to a device for disconnectably connecting cable wires to a contact plate, and particularly to such a device designed to engage two different cable wires in a housing of electrically non-conductive material, preferably plastics material, wherein one of the cable wires to be contacted can be brought into contact with the contact plate, preferably, by means of a screw element.

SUMMARY OF THE INVENTION

An electrical contacting device for connecting cable wires is known, for example, from EP-0 315 345-A2. In the known device, contact plates are provided in pairs in a plastics housing. The contact plates have metal slots on both sides which, are in the form of cutting blades, and are thus able to cut through the insulating jacket of the cable wire to be contacted and clamp the metallic conductor inside them. An electrical connection is thus made by means of this contact plate between the two contacted cable wires. If one of the cable wires has been preinstalled, for example at the factory, the idea of such devices is to insert the cable wire to be connected and press it by means of a thrust element between the cutting blades in the contact plate. In the known solution, this is achieved by means of a cap screw with the aid of which cable wires are pressed in pairs into contact plates arranged in pairs.

The known solution has a number of advantages, but does involve some disadvantages. As examples the following may be mentioned.

(1) The contacting mechanism is relatively complicated in that, in order to press the cable wire between the cutting blades, the cover of the device has, in practice, to be moved.

(2) Testing of whether the cable wires have been contacted or not can be carried out only with difficulty.

(3) A particular drawback is that, once a cable wire has been pressed in between the cutting blades of the contact plate, it is very difficult, if not impossible, to release and withdraw the cable wire so contacted, for example if it has not been installed correctly. In order to do this, it is necessary to unscrew the entire lid so that the contacted cable wire can be lifted out using a tool.

An object of the present invention is to provide a solution which simplifies construction, and which renders possible both testing for contacting and easy removal of a cable wire once contacted should the cable wire have to be replaced.

Thus the present invention provides a device for disconnectably connecting cable wires to a contact plate designed to engage two different cable wires, wherein the cable wire to be contacted can be brought into contact with the contact plate preferably by means of a screw element characterised in that (a) the contact plate is provided with a through opening for the cable wire to be contacted, and (b) a thrust piece is provided, which surrounds or overlaps at least part of the contact plate and is longitudinally displaceable thereover, wherein the thrust piece is also provided with a through opening, corresponding to, and movable relative to, the through opening in the contact plate.

DETAILED DESCRIPTION OF THE INVENTION

Figure 1:
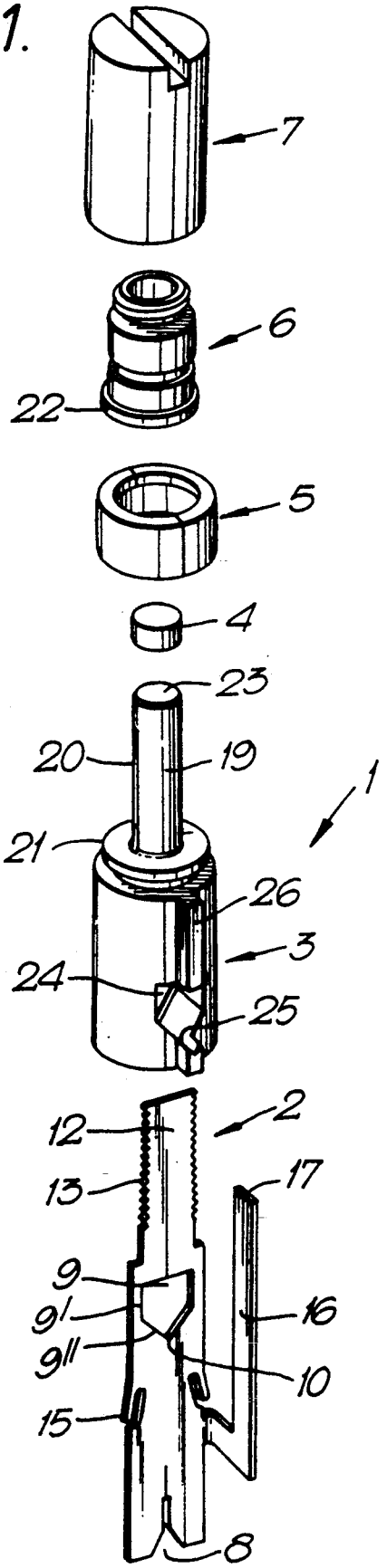

Preferably the device is mounted in a housing of electrically non conductive material.

Preferably the contact plate is secured non displaceably in the housing.

The invention provides a number of advantages compared to the known solution described above. For example it is possible to use simple components, for example rotationally symmetrical components. The through openings in the thrust piece can be used not only for contacting, but also for releasing a cable wire once contacted. This is described in detail hereinafter. The force to be applied in contacting can be controlled in a simple manner, and so on.

Further advantages of the invention are apparent in preferred embodiments of the invention which are described hereinafter.

For example testing means may be provided to check the electrical contact made. In one embodiment a test vane is provided integrally, but at an angle to the contact plate. Alternatively one region of the contact plate itself can be used for testing, in which case test bores may be made in parts, for example in screw elements, that are provided electrically connected to the contact plate.

In order to fix the contact plate spatially in a simple manner, the contact plate is preferably provided with locking elements to secure the contact plate in the particular receiving housing. The locking elements are preferably splayed outward in the same plane or folded over at right angles during installation.

By providing the thrust piece with a through opening, it is equipped not only with a thrust surface (to urge the cable wire into contact with the contact place), but by reversing the movement (preferably screwing movement) which effected the contact, it is possible to lift a wire that has been pressed into contact, thereby releasing the wire.

In a first preferred embodiment the contact plate comprises a sheet metal vane having toothed outer edges. These toothed edges preferably project through longitudinal slits in a guide cylinder which is provided on, or extends from the thrust piece. Preferably a threaded insert element, e.g. a threaded cap is provided which has an internal thread arranged to slide over the guide cylinder and to engage the toothed outer edges of the contact vane. Thus the guide cylinder, together with the thrust piece, can act as a plunger which can be moved downward and upward relative to the contact plate, for example by turning the threaded element.

In a second preferred embodiment the thrust piece is moved relative to the contact plate by the action of a drive cylinder which abuts against the thrust piece. The drive cylinder is moved axially relative to a housing for the device. Preferably this is achieved by providing an external screw thread on the drive cylinder, and a corresponding internally threaded ring, which surrounds the drive cylinder, and is fixed relative to the housing. The drive cylinder is preferably separate from, but may be integral with, the thrust piece.

The through opening in the thrust piece is preferably substantially similar in shape and size to the through opening in the contact plate. In use, before insertion of a cable wire, the through opening provided in the thrust piece is positioned in register with the through opening in the contact plate. Then a cable wire is inserted into the in-register through openings. Finally the through opening in the thrust piece is moved (preferably downwards) relative to the through opening in the contact plate. In the first preferred embodiment described above this can be done by screwing the threaded insert onto the toothed edges of the contact plate. This relative motion of the through openings in the thrust piece and the contact plate causes edges (preferably the upper edges) of the through opening in the thrust piece to force the cable wire against edges (preferably the lower edges) of the through opening in the contact plate, thereby cutting through any insulation on the cable wire to contact the conductor within. In the second preferred embodiment described above, the relative movement of the through openings in the contact plate and the thrust piece can be achieved by screwing the drive cylinder into the surrounding fixed ring, causing the drive cylinder to push downwards on the thrust piece.

If it is desired, later, to withdraw the inserted cable wire, the through openings in the contact plate and the thrust piece are simply moved back into register, for example in the first and second preferred embodiments, by unscrewing the relative threaded elements, causing the lower through opening in the thrust piece to lift the cable wire upwards from its engagement with the contact plate, thus allowing easy withdrawal. This arrangement minimises the possibility of the insulation of the cable wire being trapped by the edges of the contact plate if the cable wire is withdrawn. Thus the through opening in the thrust piece can act both to force the wire into contact with the contact plate, and to release the wire from the contact plate for withdrawal.

It should be noted that all references to upwards, downwards, upper, lower, vertical and the like are used for convenience. They indicate only the relative positions of the component parts of the device.

The through opening in the thrust piece may be provided in a number of configurations. In one embodiment it is provided as a bore through a solid end of the thrust piece. In this case, it acts on the wire on both sides of the contact plate. In a preferred embodiment, the through opening in the thrust piece is provided as an aperture in a substantially planar projection at one end of the thrust piece. In this case the aperture in the projection is preferably arranged, in use, to be only behind the corresponding through opening in the contact plate (the word behind being used in relation to the direction of insertion of the cable wire). This arrangement has a number of advantages. For example, it minimises the possibility of the core insulation being trapped within the device if a cable wire is withdrawn. Also it allows easy entry of insulating sealing material, such as gel, around the contacted wire, as described hereinafter.

The thrust piece is preferably also equipped with longitudinal guides so it can slide within a housing in the axial direction but cannot rotate.

Where the through opening is in a plate extending from one end of the plunger on one side only (preferably behind) the contact plate, the longitudinal guides on the thrust piece are preferably arranged such that the thrust piece can only be inserted into the device housing in one orientation, viz so that the through opening at the end of the plunger is correctly positioned.

The guides on the thrust piece may be channels or ridges, on its outer surface, which mate with corresponding ridges or channels on the inside of the bore of the housing.

In the first preferred embodiment described above, comprising a guide cylinder and a threaded insert, the thrust piece is preferably provided with an outwardly pointing annular projection at its upper edge towards the guide cylinder, and the threaded insert (fitted over the guide cylinder) is preferably provided with an outwardly pointing annular projection at its lower edge towards the thrust piece. A split clamping ring is then preferably positioned over the annular projections. The plunger and the threaded insert are thus connected to each other so as to be rotatable relative to each other but to be fixed relative to each other in the axial direction. This arrangement facilitates mounting and simplifies manufacture. The thrust piece can be guided to slide in the housing.

In one embodiment the split clamping ring comprises a C-shape ring, which is sufficiently resilient to allow the arms of the C to be opened and the ring sprung into position around the outwardly pointing annular projections on the upper edge of the thrust piece, and the lower edge of the threaded insert. In another embodiment the split clamping ring comprises two separate or hinged half shells which can be opened to position the ring around the annular projections, and then closed and held in a closed position by a mechanical retaining means, such as a clip or the like. The latter embodiment is preferred because it avoids the risk of the clamping ring springing open during axial motion of the threaded insert and the plunger.

The device may also comprise a cap having a blind bore which, for example, in the first preferred embodiment, described above, can be fitted over the threaded insert so that rotation between the cap and the insert is prevented. The cap preferably comprises an electrically non-conductive material. Preferably the cap is provided with a screw head so that a screw driver can be used to turn the cap and hence the threaded insert. A screw head with a blind bore, can also be provided in other embodiments.

A resilient element, such as a spring, is preferably also provided between (i) whatever element is moved to act on the thrust piece, and (ii) the thrust piece. For example, in the first preferred embodiment, where advantageously a cap is included, the resilient element is preferably arranged so that it is compressed between (i) the cap (and/or the threaded insert) and (ii) the guide cylinder, when the threaded insert is turned to move the through openings in the contact plate and the thrust piece relative to each other. In one embodiment the resilient element is compressed between the blind end of the cap and the free end (upper end) of the guide cylinder. In another embodiment the guide cylinder has an end portion of smaller cross-section than the remainder of the guide cylinder, so that it presents a shoulder. In this case the resilient element is preferably in the form of a helical spring which fits around the end portion of smaller cross-section of the guide cylinder. The resilient element, in this case is thus compressed between (i) the cap and (ii) the shoulder on the guide cylinder.

In the second preferred embodiment, described above, the resilient member is preferably provided between the drive cylinder and part of the thrust piece.

One purpose of the resilient member in the cap is to exert a continual force on the guide cylinder and hence onto the thrust piece, and, in use, an inserted cable wire. This inter alia compensates for changes of pressure in the contact region which may occur after prolonged use, e.g. due to relaxation of the insulation on the cable wire.

The contact plate is preferably made from metal, especially preferably from copper, Preferably the contact plate is punched from sheet metal.

The contact plate contains a through opening, in the form of an aperture in the contact plate, for receipt of a cable wire. In use the cable wire is forced against an edge of the aperture in the contact plate, causing cable wire to be pinched, and the insulation of the cable wire cut, so that the conductor of the cable wire is in electrical contact with the contact plate. In order to make this easier, the aperture in the contact plate is preferably prism shaped, that is it has straight edges meeting at corners. Preferably the aperture is shaped so that the wire is forced between two straight sides, and then along edges tapering from those straight sides towards each other. Depending on the size of the cable wire, the wire will need to be forced a different distance along those tapered edges of the aperture in order to pierce the insulation and contact the wire.

Over pressure of the wire into the aperture (which would cut the wire as well as the insulation) may be prevented (i) onto large wires, by tightening to a predetermined tension, and (ii) onto small wires by a physical stop. This physical stop may be, for example, contact of the inside end of the thrust piece against shoulders on the contact blade.

For small wires, particularly those with conductors of 0.5 mm diameter or smaller, it is desirable, to ensure a good contact, to provide a slot at the base of the aperture in the contact plate. This slot provides sharp edges which will cut into the insulation of the small wire.

In a preferred embodiment, in order to achieve additional fixing and loading of the inserted cable wires, and particularly applicable where the same device is to be used for contacting small wires (conductor diameter 0.5 mm or less) as well as large wires, it is preferred that the device includes a further resilient element which exerts a resilient force onto the cable wire which is additional to the force exerted by the thrust piece and the earlier mentioned resilient member in the cap e.g. in the first preferred embodiment, the resilient element in the cap. Thus, e.g. in the first preferred embodiment, even where the threaded insert has been turned onto the contact plate to its limit, e.g. until it meets a physical stop, such as the shoulders on the contact plate, the further resilient member continues to exert a force onto the cable wire. This further resilient member acts independently of the above earlier mentioned resilient member e.g. the resilient member provided in the cap of the device.

In one preferred embodiment the further resilient member is an elongate shape, e.g. in the form of a strip, bar or rod. The elongate shape resilient member may comprise a single length, or may be folded-back onto itself, e.g. in the manner of a hair grip, to form an elongate "V" or "U" shaped further resilient member with a slot through the "arms" of the "V" or "U". The further resilient member is preferably arranged at the base of the thrust member. Where a "V" or "U" shaped further resilient member is used it is preferably arranged at the base of the thrust piece so that the contact plate can slide between the "arms of the "V" or "U".

In another embodiment the further resilient member such as a helical spring is positioned at the base of the threaded insert. In this case a plate is preferably arranged within the cap which abuts the top of the contact plate and hence provided a stop when the threaded insert has been turned a predetermined distance, which is determined such that in that position the further spring is fully compressed. Thus in both embodiments, for small cables, an additional force is exerted onto the cable wire, independently of any first resilient member within the cap. This additional force is preferably large enough to ensure good contact between the conductor of the cable wire and the contact plate, even if the insulation on the conductor relaxes, but not so large that it cuts through the conductor.

In the second preferred embodiment, where an internally threaded ring is used which cooperates with an externally threaded drive cylinder to act on the thrust piece, the internally threaded ring is preferably fixed in the housing. To do this it is preferably provided with locking hooks. These can preferably be fixed in the housing by turning through 90°.

One or more of the guide cylinder, the thrust piece, and the cap, if present, preferably comprise a reinforced polymeric material, e.g. a polycarbonate material, especially a glass fibre or glass-ball filled polymeric material.

In a preferred embodiments of the invention the device is equipped with a means for testing that a contact has been made between the contact plate and an inserted cable wire.

In one embodiment including a testing means, the testing means comprises a test contact vane which is electrically connected to, preferably integrally formed with the contact plate. This additional contact vane is preferably arranged in use so that it is folded substantially at a right angle to the plane of the main vane of the contact plate. With this construction the device housing is preferably provided with a corresponding test bore into which the additional test contact vane extends such that testing of whether an electrical contact exists between the contact plate and the inserted cable wire can be carried out by inserting a testing probe into the testing bore.

In another embodiment including a testing means, where the device also comprises a cap of substantially non electrically conductive material positioned over the threaded metal insert (as hereinbefore described), a testing bore is provided into the cap. The bore in the cap is arranged to allow a test probe to be inserted into electrical contact with the threaded insert in the cap, and hence into electrical contact with the contact plate (since the threaded insert is screwed onto the toothed edges of the contact plate). This embodiment avoids the need for a separate contact vane on the metal contact plate, and also avoids the need for a separate test bore in the device housing.

Another arrangement, which can be used in the second preferred embodiment is for a conductive member, e.g. in the form of a rod, to extend up into the drive cylinder. Testing can then be achieved by inserting a test probe into the drive cylinder, e.g. through an upper screw thread.

Preferably two or more, more preferably a plurality of contact blades and associated plungers are provided in a common housing.

Preferably, a reservoir for insulating sealing material such as a gel is provided in the housing, especially around the entry regions for the cable or cables. Preferably an overflow space is provided in the housing, to allow for displacement of the gel when a cable wire is inserted. The functional behaviour of a gel material, in particular its high elongation, means that if the cable wire is withdrawn the gel is dragged back from the overflow space to its sealing position for sealing a newly inserted cable.

Examples of suitable insulating gels are described in U.S. Pat. Nos. 4,600,261, 4,634,207, 4,595,635.

Where a gel is used the contact plate is preferably provided with one or more further apertures to allow easy passage of gel through the contact plate. This ensures that the gel conforms to the surface of the cable wire forming a good seal, and is not hindered in its conformation by the presence of the contact plate.

In a preferred embodiment the case is provided with a flexible lip at the point of entry of the cable wire. This lip serves inter alia to prevent or minimise loss of gel from the housing if a cable wire is withdrawn. As the wire is withdrawn the lip is drawn towards the wire, scraping any residual gel from the surface of the wire insulation as the cable wire is withdrawn.

The housing is preferably also provided with a stop member arranged to limit the distance of insertion of a cable wire.

The invention also provides for the contact elements to be assembled into blocks in a modular design, the individual black modules being so arranged on a mounting plate that the contact opening for the cable wires to be contacted is arranged on one side of the mounting plate whilst the contact plate for the other cable wire contacts, is arranged on the other side of the mounting plate. The contact plate for the other cable wire contacts may be preconnected at the factory, or installed in the field. Where the other cable wire contacts are installed in a factory they may typically be sealed with, for example, a standard potting composition. Where they are installed in the field, they are preferably sealed with a gel of the type described hereinbefore.

It may be advantageous to cover the reverse side of the mounting plate with a closure housing which is provided with insulating gel at least in the region of the contact modules. As a development, provision can be made for the mounting plate and the closure housing to be pivotally connected to each other.

The same may be said finally for a closure flap covering the contact plane, which closure flap is pivotally fastened in turn to the mounting plate and/or to the closure housing.

The latter construction makes it possible for the individual planes to be opened at any time by competent persons for work to be carried out, whether it be the plane beneath the mounting plate, for example for the post office or a corresponding authority, or the side above the mounting plate for the end user making a connection.

Figure 2:
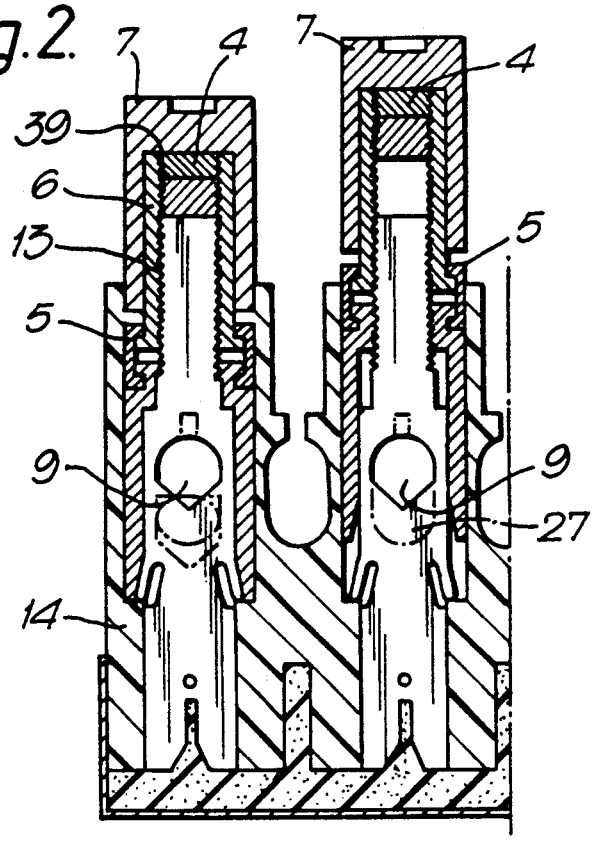
Figure 3:
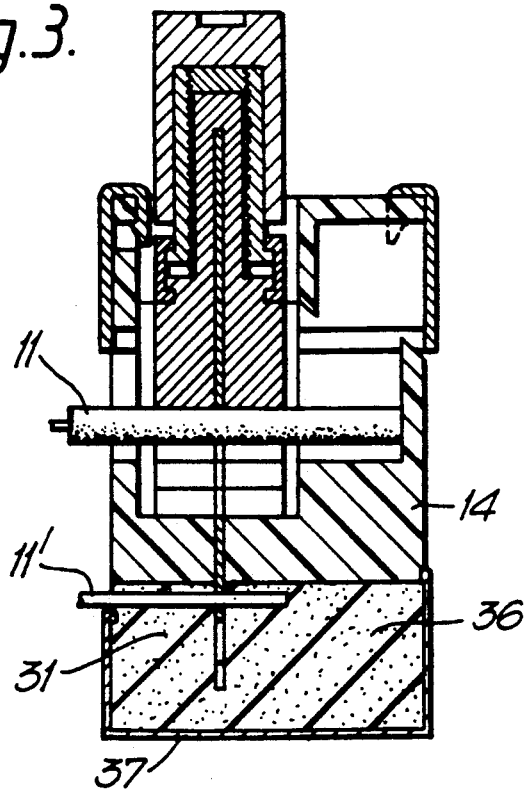
Figure 4:
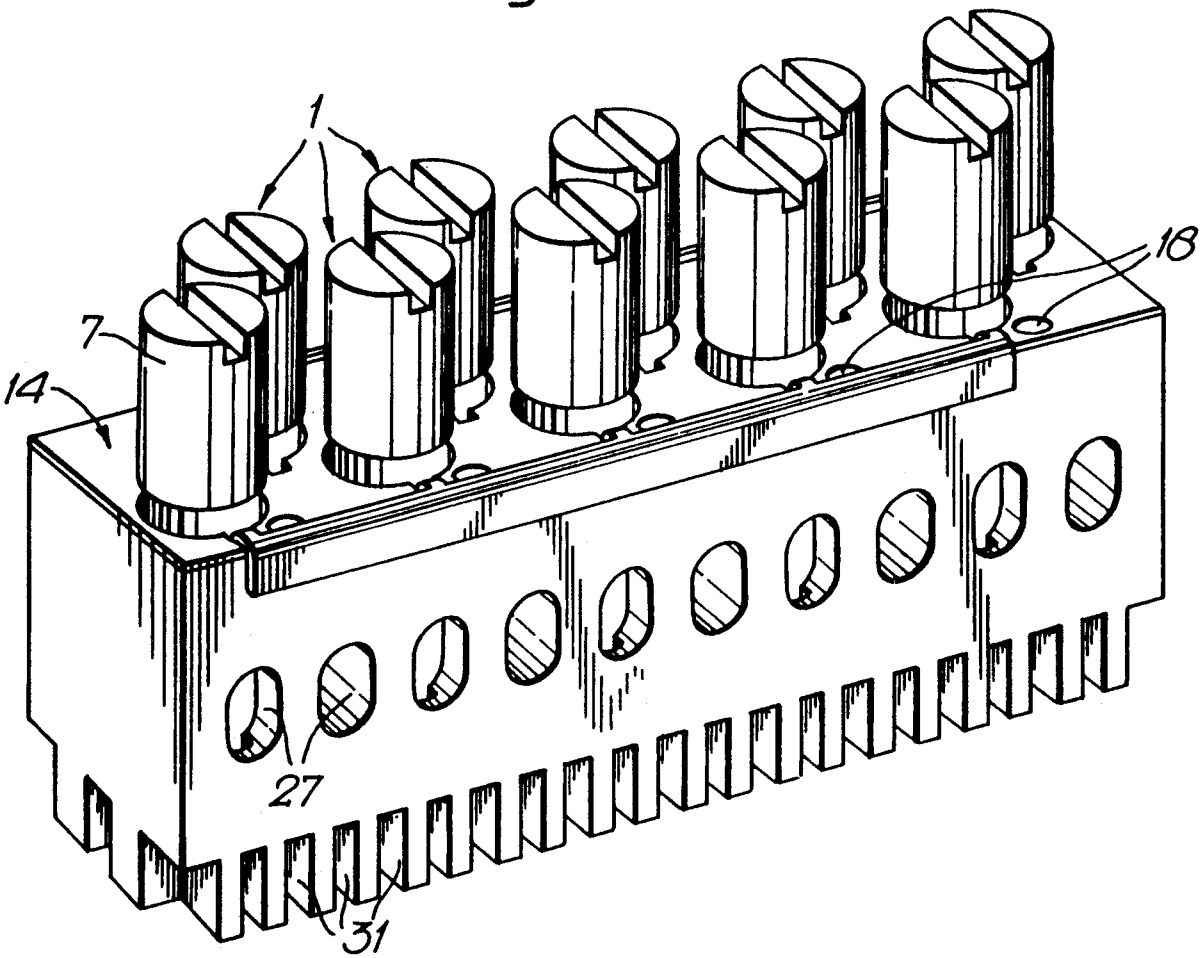
Figure 5B:
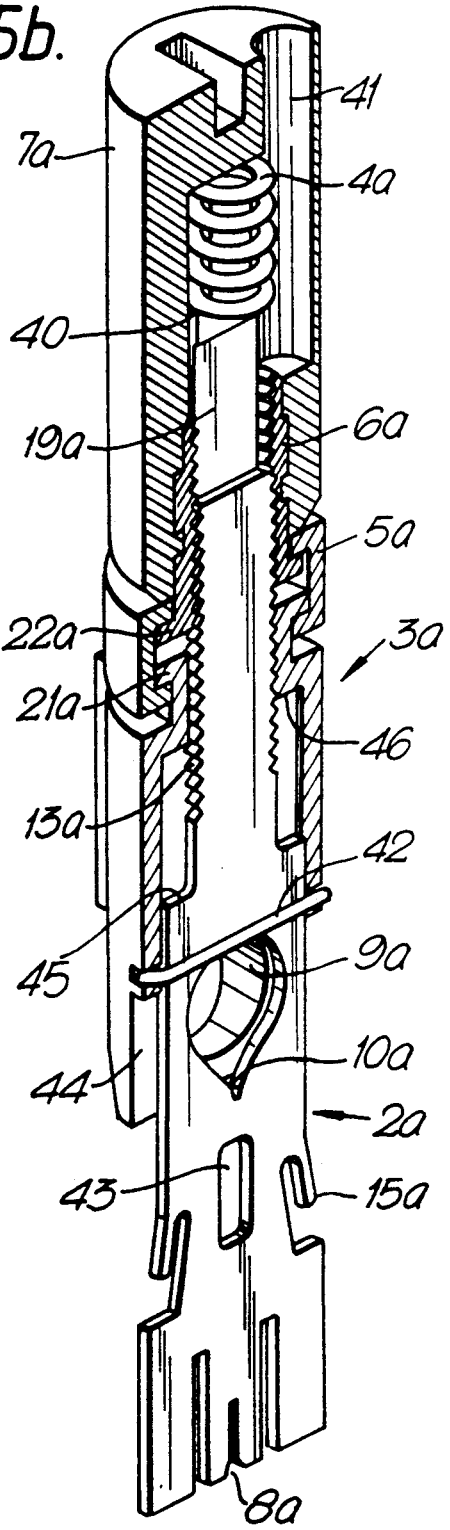
Figure 5A:
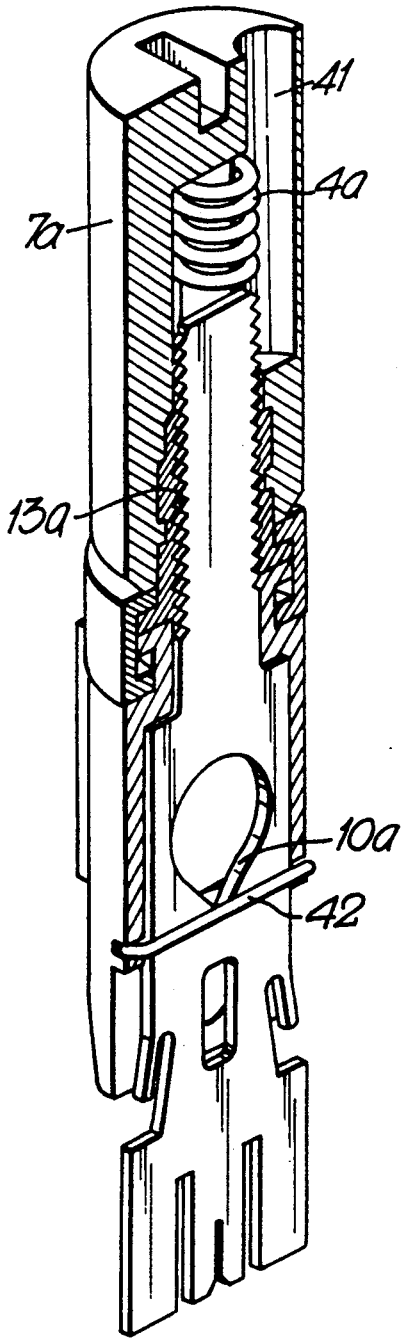
Figure 6A:
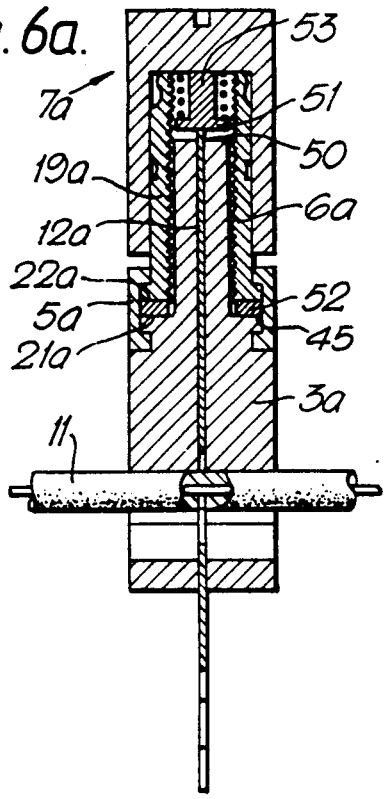
Figure 6B:
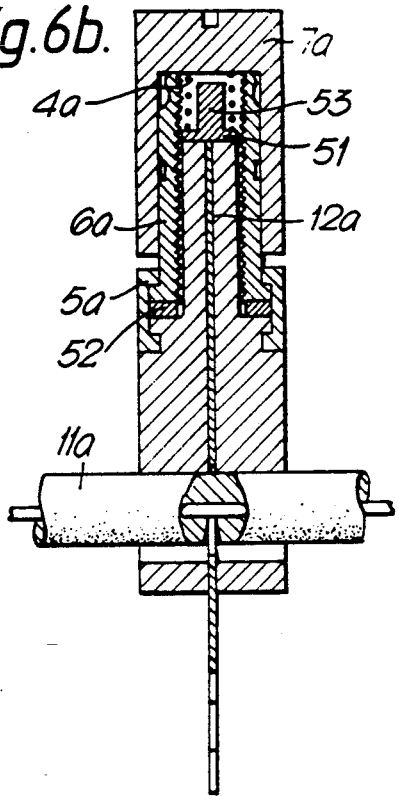
Figure 7A:
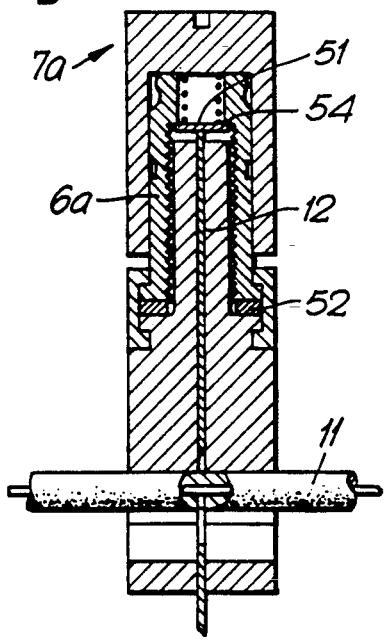
Figure 7B:
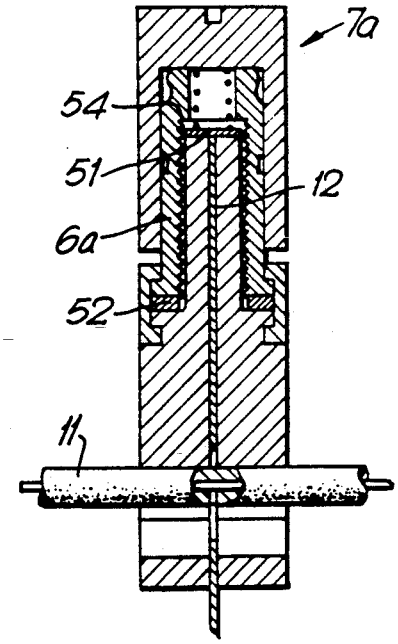
Figure 8:
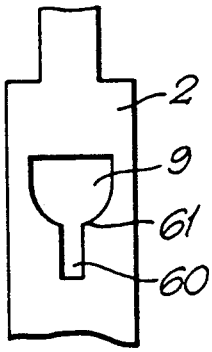
Figure 9:
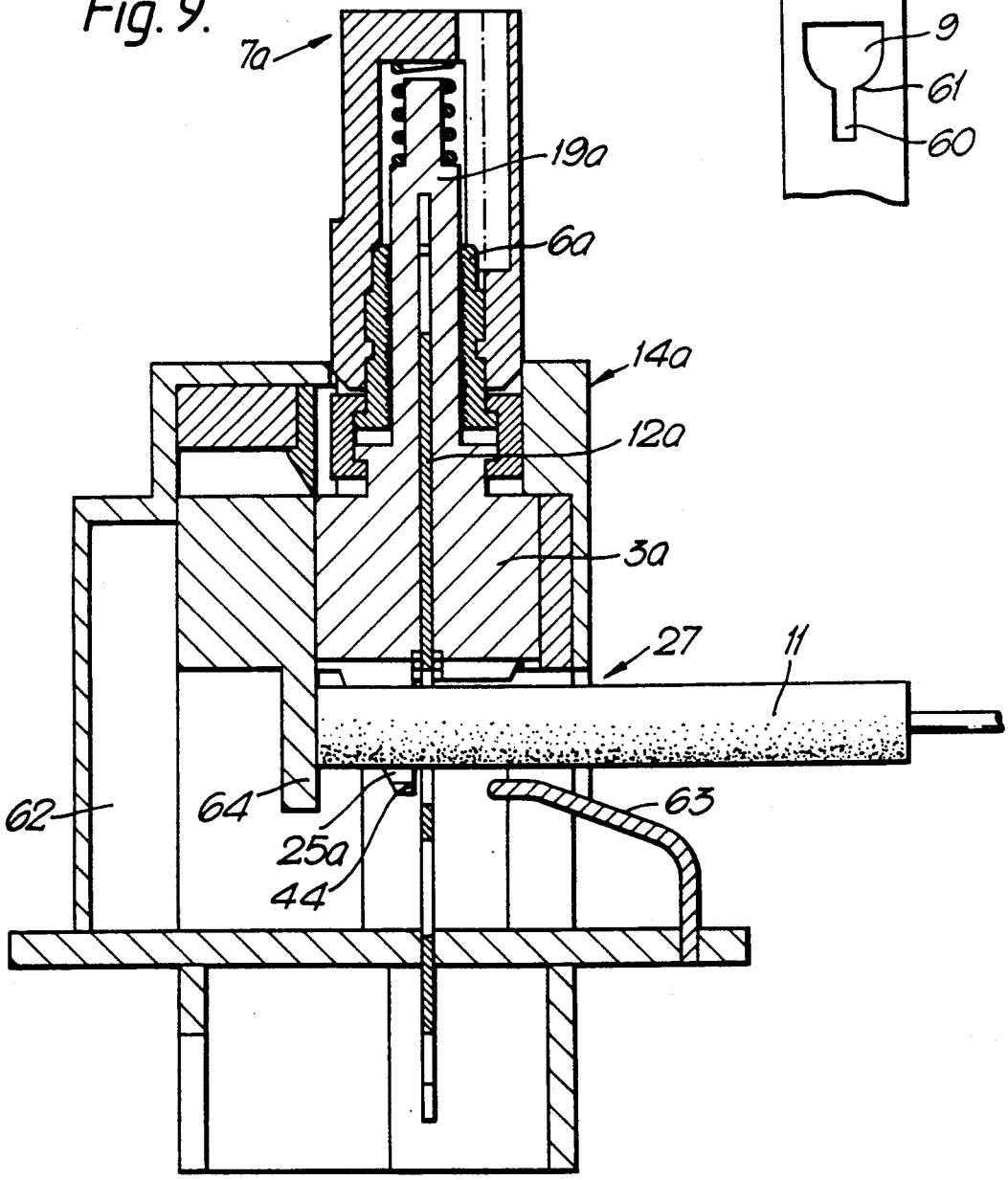
Figure 11:
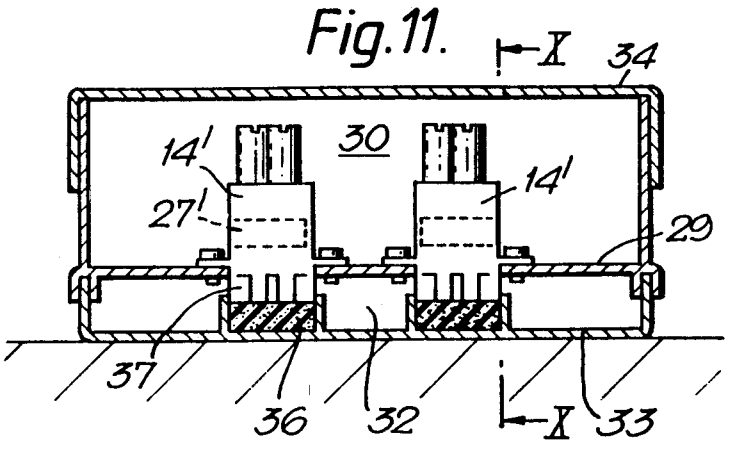
Figure 10:
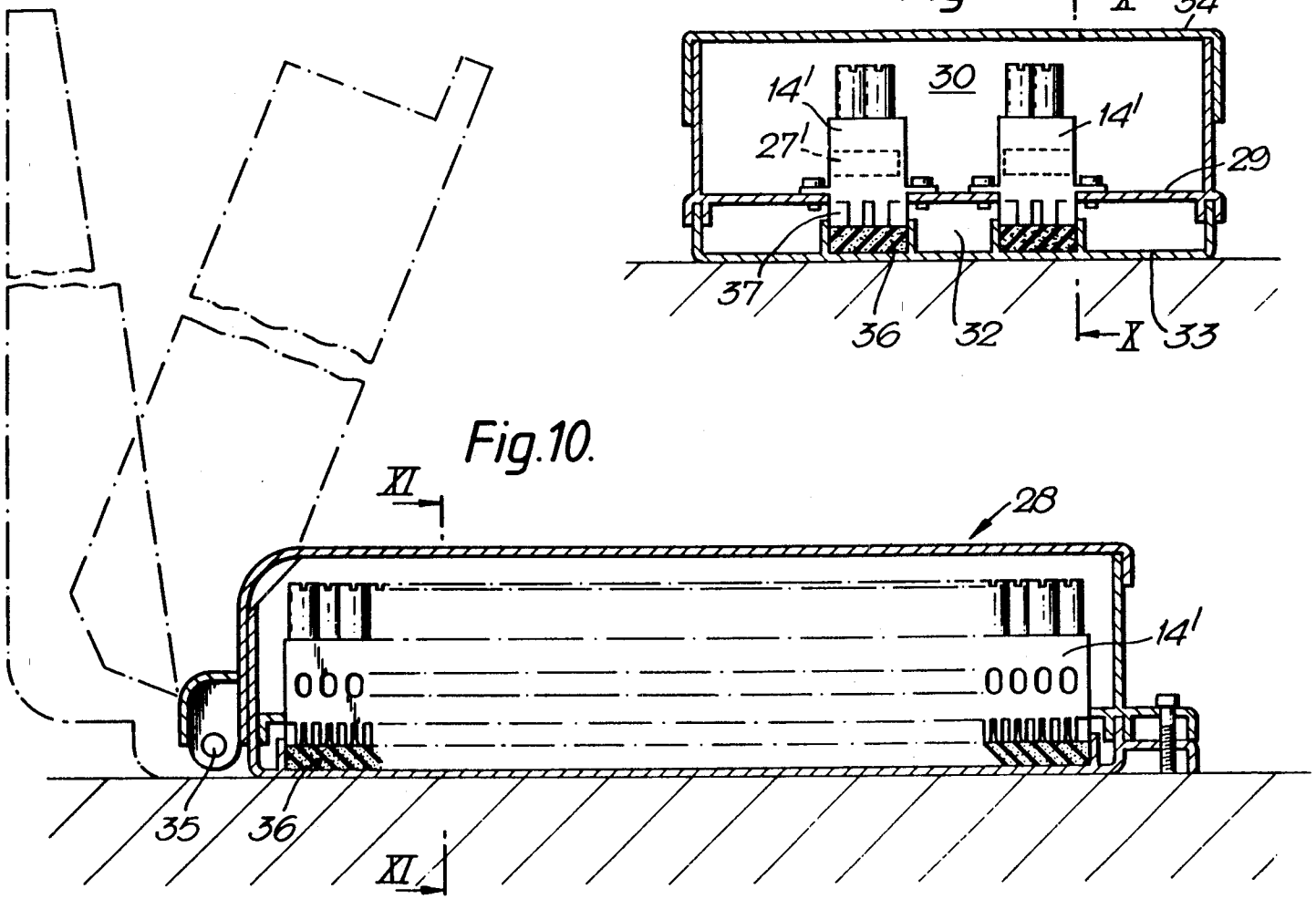
Figure 11A:
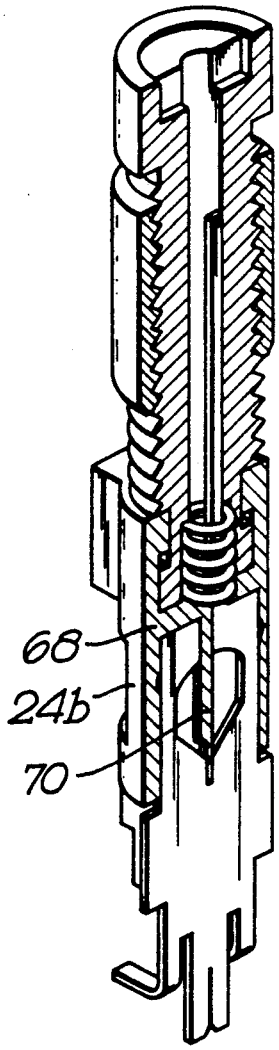
Figure 11B:
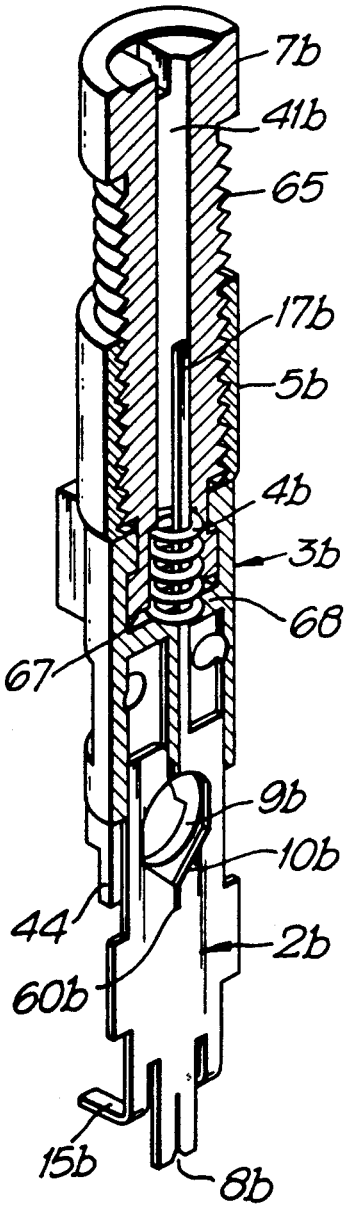
Figure 12B:
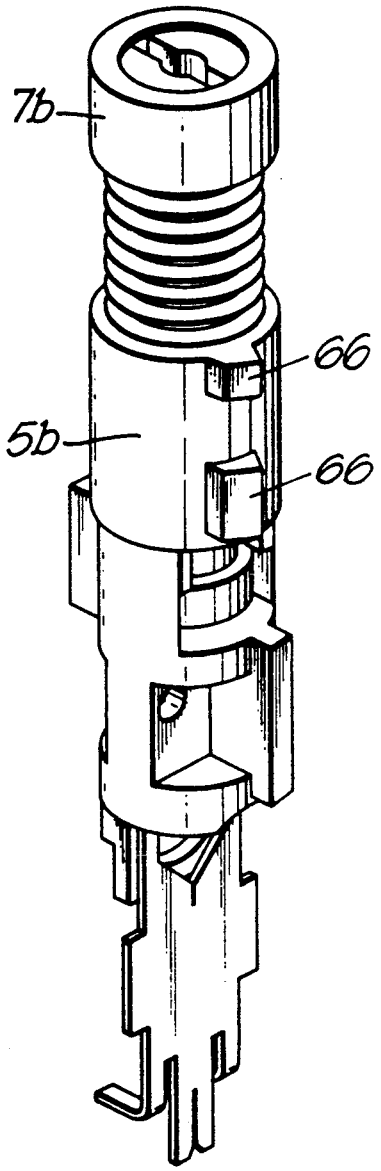
Figure 12A:
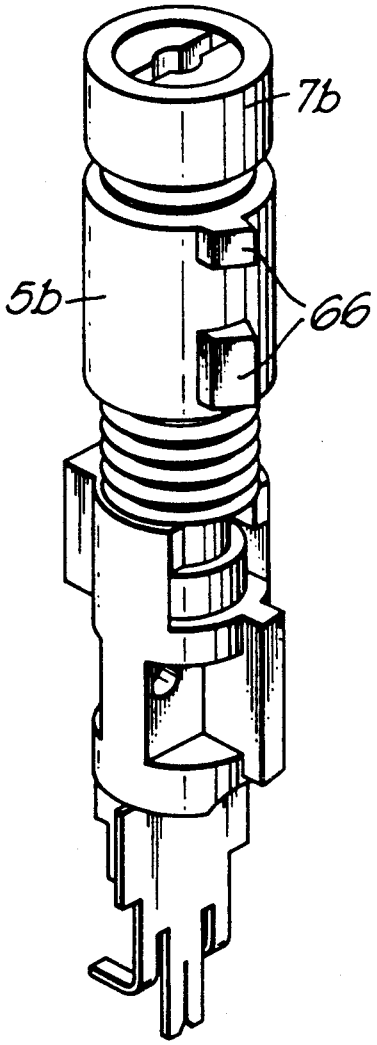
Figure 13:
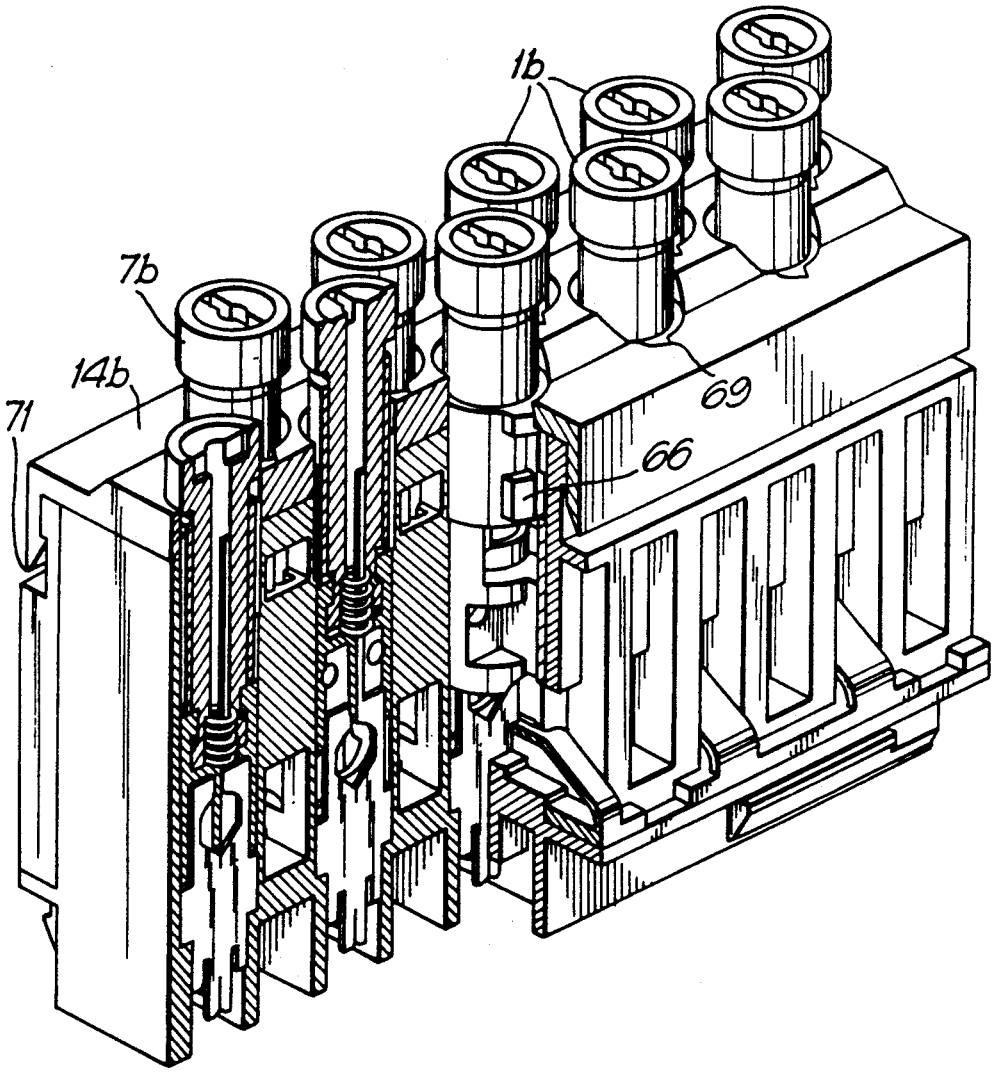

The invention is described in detail below, by way of example, with reference to the drawings in which:

FIG. 1 is an exploded view of a connection element according to a first embodiment of the invention without housing, FIG. 2 is a section through a housing region with two connection elements, FIG. 3 is a section through part of the housing, perpendicular to the sectional view shown in FIG. 2, FIG. 4 is a three-dimensional view of a housing without base plate, FIGS. 5*a* and 5*b* are three-dimensional cross-sectional drawings of a further embodiment of the invention, with the thrust piece lowered in FIG. 5*a* and raised in FIG. 5*b*, FIG. 6*a* and 6*b* are cross-sectional drawings of further embodiments of the invention, FIGS. 7*a* and 7*b* are cross-sectional drawings of further embodiments of the invention, FIG. 8 is a plan view of a region of the contact place in accordance with one embodiment of the invention, FIG. 9 is a partial section through a housing in accordance with one embodiment of the invention, FIG. 10 is a section through a plurality of housings having a common connection box, FIG. 11 is a section approximately along the line XI—XI in FIG. 10, FIGS. 11*a* and 11*b* are three-dimensional sections through a further embodiment of the invention, FIGS. 12*a* and 12*b* show the same embodiments of the invention not in section, and FIG. 13 is a three-dimensional view of a housing, partly in section, without base plate, according to the embodiment shown in FIGS. 11 and 12.

In the following description, essentially three different possible constructions are described in detail and, as far as possible, functionally identical parts bear identical reference numerals, if necessary additionally provided with an "a" or a "b" in the case of the modified embodiments. For example, the contact element shown in FIGS. 1 to 3 is generally designated 1, that shown in FIGS. 5*a* and 5*b* generally 1*a* and that shown in FIGS. 11*a* and 11*b* is designated 1*b*, to mention but one example.

Referring to the drawings, FIG. 1 shows a single contact element, generally designated 1, in a so-called exploded view. Considering the drawing from the bottom to the top, there are shown, a thrust piece 3, a resilient element 4, a split clamping ring 5, a screw element 6 and finally an operating screw head 7 which fits over the screw element.

The contact plate 2 has a lower blade-like slot 8 for cable wires to be contacted in the housing. Connection to slot 8 may be connected in the factory, or in the field. For cable wires that are to be inserted in the field, for connection to those already contacted, or later to be contacted by slot 8, an inner through-opening 9 is provided in the contact plate 2. The through opening 9 is prism shaped having straight sides 9', extending to tapered edges 9'' which taper to a point 10. A cable wire (designated 11 in FIG. 3) is inserted, in use, into through opening 9.

At its upper end, the contact plate 2 is equipped with a sheet metal vane 12 which is toothed at both outer edges 13, the teeth being adapted to a screw pitch, i.e. two corresponding, substantially mutually opposite teeth exhibit a difference in height that would correspond to a screw turn over a sector of a circle.

In order to be fastened in the plastics housing, which is not shown in FIG. 1 but is designated 14 in FIG. 2, the contact plate has two opposite, splayed clamping projections 15. A test contact vane 16 is formed on at right angles to the principal plane of the contact plate 2, the free end 17 of which vane 16 lies, in the mounted position, in the interior of a test bore designated 18 in FIG. 4 which in use is filled with an insulating gel. For contacting, a testing probe is passed through the gel onto the free end 17 of the test contact vane 16 so that a corresponding measurement can then be taken.

The thrust piece generally designated 3 has an upper guide cylinder 19 having lateral slots 20 through which the toothed outer edges 13 of the contact plate 2 project in use, as is shown, for example, in FIG. 2. In the region of transition between the thrust piece 3 and the guide cylinder 19 which is integrally formed thereon an annular projection 21 is provided. In use, an internal thread, not shown in FIG. 1, of a screw element 6 fits over the toothed outer edges 13. In order to create a rotatable, but otherwise fixed, connection between the thrust piece 3 and the screw element 6, the screw element 6 also has an annular projection 22 corresponding to the annular projection 21 on the thrust piece 3, a split clamping ring 5 being arranged over the two annular projection 21 and 22. This may be in the form of a resilient spring C-shaped member, or in the form of mating half shells, held together by a mechanical arrangement. The screw element 6 is additionally equipped with an operating screw head 7 provided with an inner blind bore, there being provided between the free end, designated 23, of the guide cylinder 19 and the base 39 of the blind bore in the operating screw head 7 an elastic spring element 4 so as to be able to act in the direction of the contact in the event of variations in the contact pressure, e.g. due to relaxation of the wire insulation.

Just as the contact plate 2 is provided with a through opening 9 having a prism shaped aperture tapering to a point 10 the thrust piece 3 is also equipped with a corresponding through-opening 24. This may likewise have a tapered aperture 25 which, in use, is in register with the through-opening 9 in the contact plate. In order to prevent the thrust piece 3 from turning with the screwing movement of the screw element 6, lateral guide projections 26 are provided.

The two screw positions (full unscrewed and full screwed) are shown side-by-side in FIG. 2. First of all, the plastics housing 14 is equipped with entry apertures 27 corresponding to the number of contact elements 1, as shown in FIG. 4. The through-opening 9 in the fixed contact plate 2 which is clamped in the housing 14 is substantially in alignment with these entry apertures 27, the latter being larger, however, to allow relative movement of the inserted cable wire 11. The through-opening 24 in the thrust piece 3 is exactly in alignment with the opening 9 in the contact plate 2 in the insertion position of a cable wire. This position is shown on the right in FIG. 2. When the cable wire is then inserted and the screw element 6 is turned by means of the operating screw head 7, the screw element is screwed downward over the toothed outer edges 13 of the fixed contact plate 2 together with the thrust piece 3 in such a manner that an inserted cable wire is squeezed from the top of the through-opening 24 towards the point 10 of the aperture in the contact plate 2. This position is shown on the left if FIG. 2.

To open or unmake the contact, the operating screw head 7 is turned in the opposite direction so that the thrust piece 3 is moved upward. Therewith the pinched cable wire is lifted by means of the aperture 24 in the thrust piece away from the point 10 of the aperture 9 in the contact plate 2 and can subsequently be withdrawn from the device.

FIGS. 5*a* and 5*b* shows an alternative embodiment of device according to the invention. The thrust piece is lowered in FIG. 5*a* to caused contact, and raised in FIG. 5*b*. This embodiment is similar to that already described with reference to FIGS. 1 to 4, and like reference numerals are used to indicate like parts in FIGS. 1 to 4 and FIG. 5, with the addition of suffix "a" in FIG. 5. Different features in the embodiment of FIG. 5 are as follows. A testing port 41 is provided in cap 7*a*. To test whether contact has been made between an inserted cable wire and the contact plate 2*a*, a test probe is inserted into the test port 41 into electrical contact with the threaded metal insert 6*a*. The threaded metal insert is in electrical contact with the contact plate 2*a*, and hence the test probe can be used to check that electrical contact has been made to the contact plate 2*a*. Also the spring 4*a* within the cap is a helical spring which lies over a projection 40 extending from the end of guide cylinder 19*a*. The projection 40 is of smaller cross-section than the remainder of the guide cylinder and thus the spring abuts against the shoulder existing between the projection 40 and the remainder of the guide cylinder 19*a*. In contrast the spring 4 in the cap 7 described with reference to FIGS. 1–4 was in the form of a resilient rubber ball. The through opening 25 provided at the end of the thrust piece is provided in a substantially planar plate 44, which extends on one side only of the contact plate. The through opening 25, is, as in FIGS. 1–4, in register with the through opening 9 in the contact plate 2. This arrangement facilitates withdrawal of a cable wire, and also facilitates flow of sealing gel around the cable wire. The contact plate 2 also includes an additional aperture 43 below the through opening 9. This is to make it easier for gel to flow within the housing to conform around the cable wire. A final distinction between this embodiment and that of FIGS. 1–4 is that an elongate spring 42 comprising a rod folded-back on itself into an elongate "U" shape, in the manner of hair grip, is provided at the bottom of the thrust piece. Even when the thrust piece 3*a* has been moved downwards (by screwing on insert 6*a*) so that the internal shoulders 46 of the thrust piece abut and stop against the shoulders 45 of the contact plate 2*a* the elongate spring 42 can be arranged so that it is resiliently deformed by a wire (even a small wire) in this configuration, so that it continues to exert a downward force on an inserted cable wire. The elongate spring 42 acts independently of the spring 4*a* in cap 7*a*. Indeed spring 4*a* is only effective to provide a constant resilient force when the wire is of such a size that the thrust piece 3*a* is not stopped against the shoulders 45 of the contact plate.

FIGS. 6(*a* and *b*) and 7(*a* and *b*) show alternative arrangements for providing a continual pressure on a wire, using a spring which acts independently of any spring in the cap. In both FIGS. 6 and 7, the "a" figure illustrates installation of the device onto a small diameter cable wire, and the "b" figure illustrates installation of the device onto a large diameter cable wire. As before, the devices are similar to devices already described, and therefore like reference numerals are used to describe like parts, with an "a" suffix applied for FIGS. 6 and 7 compared to FIGS. 1 to 4.

Referring first to FIG. 6, the guide cylinder 19 is open at its free end so that the vane 12*a* of contact plate 2*a* can pass through it, as shown at 50. Also the shoulders 45 on the contact plate 2 are lowered relative to those in the embodiments of FIGS. 1–4. A new stop is provided (in place of mating shoulders 45 of the contact plate 2*a* and internal shoulders 46 of thrust piece 3*a*). The new stop is provided by a plate 51 and support 52 within the cap which abuts against the top of the cap 7*a*. In this embodiment the further spring 52 is provided between the annular flange 22 of the threaded insert 6*a* and the annular flange 21 on the top of thrust piece 3*a*. When a large diameter cable wire is inserted, (FIG. 6*b*) the cap is turned until the force reaches a certain limit. In this case both the top spring 4 (in the cap 7) and the further spring 52 exert a permanent force on the wire.

When a small diameter wire is introduced, (FIG. 6*a*), the cap 7*a* is turned until it reaches its physical stop position, i.e. the top of the metal vane 12 of contact plate 2*a* abuts plate 51, and the support 53 abuts the top of the inside of cap 7. In this position the spring 4*a* in cap 7*a* no longer exerts a continuing pressure. However, in this position the further spring 52 is fully compressed and therefore exerts a continuing pressure on the small wire. The continuing pressures are desirable in order to maintain continuing contact with the cable wires even if relaxation of the wires causes a change in pressure in the contact region.

FIGS. 7*a* and *b* are very similar to FIGS. 6*a* and *b* respectively except that a physical stop is provided by plate 51 abutting against an internal shoulder 54 in the threaded insert 6*a*.

FIG. 8 shows a preferred design of through opening 9 in the contact plate 2. In this design the bottom of the opening opens into a narrow slot 60. This design ensures that for a small diameter cable wire good contact is achieved by the edges 61 of the through opening 9, i.e. those edges between the slot 60 and the main part of the through opening 9. Preferably the slot 60 is between 0.1 and 0.45 mm wide, preferably about 0.3 mm wide.

The devices shown in FIGS. 5 to 7 and the preferred feature of FIG. 8 can be used in a housing as shown in FIGS. 2–4.

FIG. 9 illustrates a preferred housing that can be used. It is shown, in section, in conjunction with the device of FIG. 5. As before like reference numerals designate like parts. Of particular note are the overflow cavity 62 in the housing 4, for flow of the gel (not shown) when a wire 11 is inserted. Also lip 63, on the front of the housing, which acts to maintain the gel in the housing if the wire 11 is withdrawn. Backstop 64 is also provided as part of the housing, to limit the distance of insertion of the wire 11. The single aperture 25 in the plate 44 extending at one end of the thrust piece 3, can also be clearly seen in this figure.

FIGS. 10 and 11 show an assembly of several contacting housings 14 constructed in modular form, but the particular configuration shown is merely an example.

Because they are in the form of block modules the contacting housing 14 shown in FIGS. 10 and 11 are designated 14'.

In the example shown, the individual block modules 14' are arranged in a housing designated 28 overall, a plurality of block modules 14' being screwed to a mounting plate 29. This mounting plate 29 divides the housing 28 essentially into two regions, the part comprising the contact openings 27' being arranged on the side designated 30 of the mounting plate, whilst the lower part comprising the contact blades 8 and the insertion slots 31 for the further cable wire 11' is arranged on the side designated 32 of the mounting plate 29.

In addition to the mounting plate 29, the housing 28 has a base plate 33 and a closure housing 34, the individual elements being pivotally attached to one another by an optionally common hinge, as is indicated by broken lines in FIG. 10.

In order to provide a reservoir for insulating gel 36 (which is particularly desirable where contact to the blades 8 is to be made in the field rather than in the factory) corresponding projections are incorporated in the base plate 33, as can be seen from the cross-section in FIG. 11.

A different arrangement for forming a gel reservoir for gel 36 is shown in FIGS. 2 and 3. In this case, a single block module is equipped with a bottom closure cap 37.

FIGS. 11 to 13 show a further embodiment of device according to the invention. FIGS. 11*a* and 11*b* exhibit the device cut away to reveal the component parts, in the lowered and raised positions respectively. FIGS. 12*a* and 12*b* are corresponding perspective views. FIG. 13 shows the devices of FIGS. 11*a*, 11*b*, 12*a* and 12*b* in a plastic housing 14*b*, the lower part of the housing, which may be filed with gel not being shown in detail.

As in the previous embodiments a contact plate 2*b*, and a thrust piece 3*b* are provided each with a corresponding through opening 9*b* and 25*b*. However in this case the relative movement of the through openings 9*b* and 25*b* is achieved by a different mechanism. In the previous embodiments the relative movement was provided by screwing a cap containing a screw element 6 over toothed outer edges of a vane extending from the contact plate. In the embodiment of FIGS. 11*a* to 13 the contact plate does not include such a toothed vane. Relative motion of the through openings 9*b* and 25*b* is instead provided in the manner described below.

An externally threaded driver 65 extends from and is integral with screw head 7*b*. Surrounding the driver 65 is a ring 5*b* with mating internal threads. The ring 5*b* is provided with external projections 66 (see FIG. 12*b*) to fix the ring 5*b* relative to the housing. Thus as the screw head 7*b* is turned, driver 65 is effectively screwed into ring 5*b*, and hence moves axially relative to it and to the housing. The lower end 67 of the driver 65 is arranged to abut against a cross piece 68 on the thrust piece 3*b*. Consequently the thrust piece 3*b* is moved axially relative to the contact plate 2*b* and, as before, a cable wire inserted into through openings 9*b* and 24*b* in the contact plate 2*b* and thrust piece 3*b* respectively, is urged into contact with the edges of the opening 9*b* in the contact plate 2*b*.

As in the previous embodiments, a resilient element 4*b* may be included, in this case between (i) the cross piece 63 of the thrust piece 3*b* and (ii) the driver cylinder 65 extending from the screw head 7*b*.

The ring 5*b* is fixed in the plastic housing 14*b* via a bayonet catch. It may be turned through 90° so that projections in the form of stop pins 66 fix it in the housing. In order that the device 1*b* can be easily mounted in the housing 14*b*, the housing 14*b* is provided with correspondingly shaped slots 69 at the top. Stop pins 66 can therefore be introduced via the slots 69 in the housing, and then the elements locked into one another by turning through 90°.

Also a rod like contact member 16*b* is preferably included extending up through the driver cylinder 60 from the contact plate 2*b*. This may be used to test for electrical contact, by inserting a test probe into contact with member 16*b* through the screw head 7*b*.

As in the embodiments of the previous figures, the contact plate 2*b* is provided with a lower blade-like slot 8*b* for contact leads (not shown) which are to be connected in the housing. For contacting the upper cable wires a through-opening 9*b* is provided in the contact plate 2*b*. This has sloped edges 10*b* to a point, and an additional lower slot 60*b*.

When completing the contacting operation an additional axial pressure is provided by contact pressure ram 70, extending downward from the cross piece 68 of the thrust piece 3*b*. The free end of this ram 67 may interlock with the contact slot 60, thereby ensuring that the cable wires, especially those of small diameter, are contacted securely.

To locate the resilient element 4b in the housing 14b, the contact plate 2b is provided with clamping projections 15b, at its lower end.

The clamping projections are bent behind corresponding studs in the housing 14b during assembly.

FIG. 13 shows the embodiments of FIGS. 11a, 11b, 12a and 12b in a housing 14b. In particular the figure illustrates the fixed position of the rings 5b in the housing 14b. It also illustrates that the individual housing elements are fixed together by click-stop connections, as indicated by reference number 71, in FIG. 13.

The described exemplary embodiments of the invention can, of course, be further modified in various respects without departing from the basic concept. For example, the contact vane 16 may be angled slightly to provide a large support surface for a contact point. The corresponding bores 18 for this contact gel may be filled with insulating gel or may be closed mechanically, and so on.

We claim:

1. A device for disconnectably contacting and connecting at least two different cable wires, the device comprising:

(a) a contact plate that is provided with (i) a through opening for receiving at least one of the cable wires to be contacted, and (ii) a sheet metal vane that is integral with the contact plate and which has toothed outer edges, (b) a thrust piece which (i) surrounds at least part of the contact plate, (ii) is longitudinally displaceable over the contact plate, (iii) is provided with a through opening corresponding to, and movable relative to, the through opening in the contact plate, and (iv) is provided with a guide cylinder having longitudinal slits through which the toothed outer edges of the contact plate project, and (c) a threaded element having an internal thread fitting as a screw element over the guide cylinder to engage the toothed edges of the sheet metal vane.

2. A device according to claim 1 also comprising a housing which is made of electrically non conductive material.

3. A device according to claim 2, wherein the contact plate is secured non-displaceably in the housing.

4. A device according to claim 2, wherein the contact plate is provided with clamping projections which form locking elements that hold the contact plate in position relative to the housing.

5. A device according to claim 2, wherein the thrust piece has longitudinal guides so as to slide in the axial direction in the housing without turning.

6. A device according to claim 1, wherein the thrust piece is provided with an outwardly pointing annular projection at its edge which is towards the guide cylinder, and the threaded element fitted over the guide cylinder is provided with an outwardly pointing annular projection at its edge which is towards the thrust piece, over which annular projections, in use, a split clamping ring is arranged, substantially to prevent relative axial motion between the threaded element and the thrust piece.

7. A device according to claim 1, wherein the device additionally comprises:

(a) a driver which can act on the thrust piece to effect its longitudinal displacement and (b) a ring member which is fixed in the housing, wherein the driver cooperates with the ring member such that the driver member can be moved relative to the housing.

8. A device according to claim 1, wherein a cap is provided having a blind bore and being made of electrically non-conductive material, the cap fitting directly or indirectly over the contact plate, and allowing access by a test probe into electrical contact with the contact plate.

9. A device according to claim 1, wherein the contact plate is provided with a test contact vane which in use is folded substantially at a right angle to the plane of the main part of the contact plate.

10. A device according to claim 1 wherein the contact plate comprises an additional through opening to allow passage of sealing material therethrough.

11. A device according to claim 1, wherein the through opening in the contact plate is generally prism shaped such that action of the thrust piece forces the wire against two angled straight edges.

12. A device according to claim 1, wherein that side of the through opening in the contact plate against which the wire is forced, in use, is provided with a slot extending away from the through opening.

13. A device according to claim 1, wherein the cable wire that is received in the through opening in the contact plate is brought into contact with the contact plate by means of a screw element.

14. A device according to claim 1, wherein an operating screw-head is provided to act on the thrust piece, and a resilient element is provided between the thrust piece and the operating screw head, so that turning the screw head will move the thrust piece via the resilient element.

15. A device according to claim 14, comprising a further resilient member which acts on an inserted cable wire in the contacting direction independently of any resilient member that may be provided between the thrust piece and the operating screw head.

16. A device according to claim 15 wherein a shoulder is provided on the contact plate and wherein, in use, the further resilient member exerts a continuing force on an inserted cable wire even after the thrust piece has been moved relative to the contact plate to abut and stop against the shoulder on the contact plate.

17. An assembly comprising (1) a housing, (2) a plurality of devices for disconnectably contacting and connecting at least two different cable wires, each device comprising (a) a contact plate that is provided with (i) a through opening for receiving at least one of the cable wires to be contacted, and (ii) a sheet metal vane that is integral with the contact plate and which has toothed outer edges, (b) a thrust piece which (i) surrounds at least part of the contact plate, (ii) is longitudinally displaceable over the contact plate, (iii) is provided with a through opening corresponding to, and movable relative to, the through opening in the contact plate, and (iv) is provided with a guide cylinder having longitudinal slits through which the toothed outer edges of the contact plate project, and (c) a threaded element having an internal thread fitting as a screw element over the guide cylinder to engage the toothed edges of the sheet metal vane, each device having contact plates arranged in the housing, and (3) a reservoir within the housing containing insulating gel.

18. An assembly comprising (1) a plurality of devices for disconnectably contacting and connecting at least two different cable wires, each device comprising (a) a contact plate that is provided with (i) a through opening for receiving at least one of the cable wires to be contacted, and (ii) a sheet metal vane that is integral with the contact plate and which has toothed outer edges, (b) a thrust piece which (i) surrounds at least part of the contact plate, (ii) is longitudinally displaceable over the contact plate, (iii) is provided with a through opening corresponding to, and movable relative to, the through opening in the contact plate, and (iv) is provided with a guide cylinder having longitudinal slits through which the toothed outer edges of the contact plate project, and (c) a threaded element having an internal thread fitting as a screw element over the guide cylinder to engage the toothed edges of the sheet metal vane, the devices being arranged so that their contact plates are assembled into blocks in a modular design, and (2) a mounting plate, wherein the individual block modules are so arranged on the mounting plate that the through openings in the contact plates for the cable wires to be contacted are arranged on a first side of the mounting plate whilst the contact plate for the cable wire contacts which are to be connected via the contact plates to the cables inserted in use in the through openings in the contact plates is arranged on the other, reverse, side of the mounting plate.

19. An assembly according to claim 18, wherein the reverse side of the mounting plate is covered with a closure housing which contains insulating gel at least in the region of the block modules.

* * * * *